US006082271A

United States Patent [19]

Gosselin et al.

[11] Patent Number: 6,082,271

[45] Date of Patent: Jul. 4, 2000

[54] FOLDING TABLE BASE

[75] Inventors: James P. Gosselin, 17 Woodland Hills Rd., Baravia, Ill. 60510; David R. Hoyt, Clifton, Ill.; Ronald L. Langevin, Cicero, Ind.; Stuart West, Watseka, Ill.

[73] Assignee: James P. Gosselin, Batavia, Ill.

[21] Appl. No.: 09/258,721

[22] Filed: Feb. 26, 1999

[51] Int. Cl.[7] ..... A47B 3/00

[52] U.S. Cl. ..... 108/133; 108/115; 108/132

[58] Field of Search ..... 108/133, 132, 108/131, 115; 248/188.1, 188.6

[56] References Cited

U.S. PATENT DOCUMENTS

| | | | |
|---|---|---|---|
| 240,301 | 4/1881 | Buss . | |
| 422,639 | 1/1890 | Schwencke . | |
| 2,531,259 | 11/1950 | Cudini . | |
| 2,860,940 | 11/1958 | De Saussure | 108/133 |
| 3,596,945 | 8/1971 | Mulvin . | |
| 4,318,353 | 3/1982 | Schier . | |
| 5,107,775 | 4/1992 | Langlais et al. . | |
| 5,354,027 | 10/1994 | Cox . | |
| 5,562,052 | 10/1996 | Glashouwer et al. . | |
| 5,673,633 | 10/1997 | Pfister | 108/132 |

FOREIGN PATENT DOCUMENTS

| | | | |
|---|---|---|---|
| 6779 | of 1914 | United Kingdom | 108/133 |

*Primary Examiner*—Jose V. Chen
*Attorney, Agent, or Firm*—Jenkens & Gilchrist

[57] ABSTRACT

A folding table base is provided which includes a mounting plate adapted to be secured to the bottom of a table. A hinge plate is hingedly connected to the side of the mounting plate. The hinge plate is adapted to pivot between a first position and a second position. A leg is secured to the hinge plate and extends generally orthogonal thereto. A latching mechanism is secured to the bottom of the table. The latching mechanism includes a latch mounting plate and a pull latch. The pull latch being slidably mounted on the latch mounting plate such that the pull latch is operable between a latched position and an unlatched position. The latching mechanism engages the hinge plate when the pull latch is in the latched position and disengages the hinge plate when the pull latch is in the unlatched position.

48 Claims, 17 Drawing Sheets

FOLDING TABLE BASE

FIELD OF THE INVENTION

This invention relates generally to folding tables, and in particular to a folding table base for easily folding and unfolding table legs that latch open.

BACKGROUND OF THE INVENTION

Tables and chairs are supported by legs that extend from a base. Some table and/or chairs include foldable legs. Folding legs take up less room and facilitate storage of the table or chair when it is not being used. Prior folding tables include a base having two foldable arms extending therefrom. The arms include a pair of legs extending from each of the arms. Each arm is foldable between a horizontal (closed) position and a vertical (open) position. These arms are traditionally locked into a vertical position by folding braces that include two members joined by a pivot point. These braces extend between the bottom of the table and each arm. When the arms are in the vertical position, the braces are straight and form an angle with respect to the bottom of the table. Generally this angle is about 45 degrees. The legs of the table are locked into the vertical position by sliding a collar down over each folding brace such that the two members can not pivot with respect to each other. To close the legs of this prior table, the collar is moved upward so each brace can bend at the pivot point approximately 90 degrees, thus allowing each arm to fold from the vertical position to the horizontal position. These types of folding tables are awkward to fold and unfold and often require more than one person to manipulate. In addition, these prior folding tables are prone to pinching fingers during set-up and take-down. Many prior folding tables are also wobbly, unstable and lack aesthetic appeal.

Therefore, a need exists for a folding table that is sturdy in construction, easy to manipulate and compact when folded to facilitate easy storage.

SUMMARY OF THE INVENTION

A folding table base is provided which includes a mounting plate adapted to be secured to the bottom of a table. A hinge plate is hingedly connected to the side of the mounting plate. The hinge plate is adapted to pivot between a first position and a second position. A leg is secured to the hinge plate and extends generally orthogonal thereto. A latching mechanism is secured to the bottom of the table. The latching mechanism includes a latch mounting plate and a pull latch. The pull latch being slidably mounted on the latch mounting plate such that the pull latch is operable between a latched position and an unlatched position. The latching mechanism engages the hinge plate when the pull latch is in the latched position and disengages the hinge plate when the pull latch is in the unlatched position.

BRIEF DESCRIPTION OF THE DRAWINGS

Other objects and advantages of the invention will become apparent upon reading the following detailed description and upon reference to the drawings in which.

Figure 1:
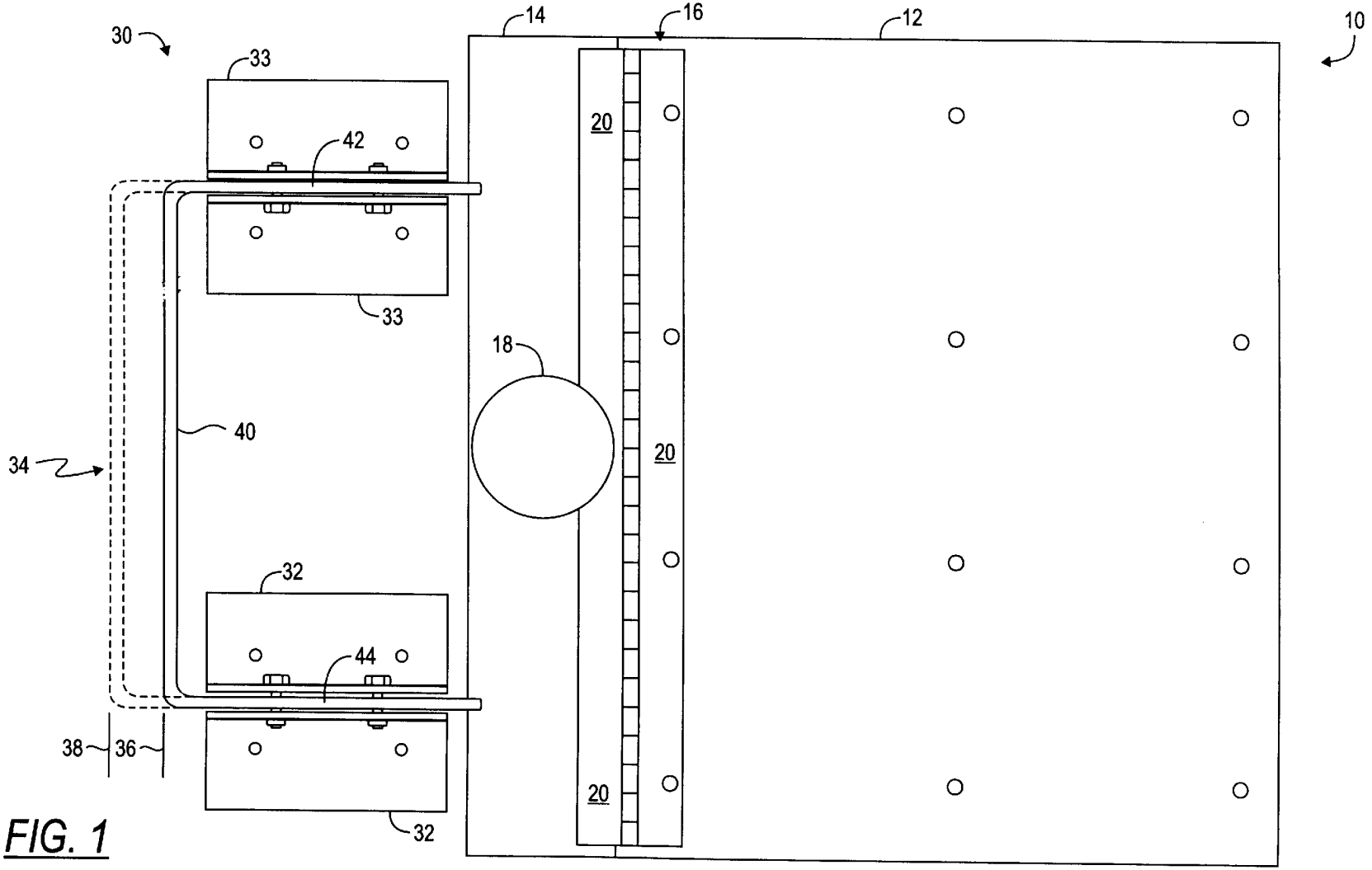
FIG. 1 is a top view of a folding table base according to the present invention in the open position.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Figure 12A:
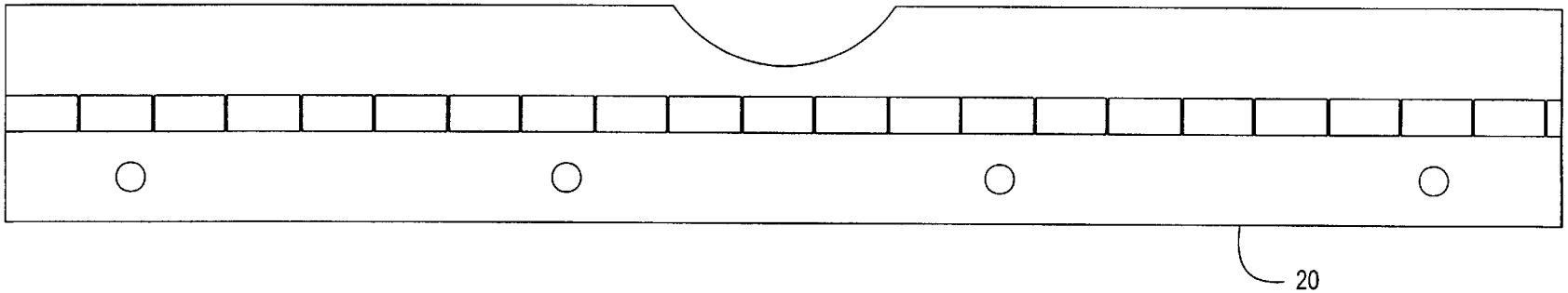
FIG. 12*a* is a top view of a hinge for use with the folding table base of FIG. 1.
Figure 12B:
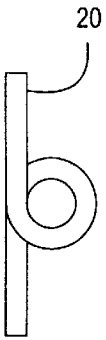
FIG. 12*b* is a end view of the hinge of FIG. 12*a;*

Referring to FIG. 1, there is shown a folding table base 10. The base 10 includes a mounting plate 12 and a hinge plate 14. The mounting plate 12 is adapted to be secured to the bottom of a table (such as the table 13 shown in FIG. 13*a*) by fasteners such as nails, screws, bolts, etc. The hinge plate 14 is pivotally connected to a side 16 of the mounting plate 12 by a hinge 20, best illustrated in FIGS. 12*a* and 12*b*. The hinge 20 is secured to the mounting plate 12 by welding, riveting, fastening, etc. The hinge plate 14 is adapted to pivot between a first position and a second position. Typically, the first position corresponds to a horizontal position or coplanar (in relation to the base plate 12) and the second position corresponds to a vertical position (in relation to the base plate 12). Returning to FIG. 1, a leg 18 is secured to the hinge plate 14 and extends generally orthogonal thereto. The leg 18 can be secured to the hinge plate 14 by welding, riveting, fastening, etc.

Figure 9B:
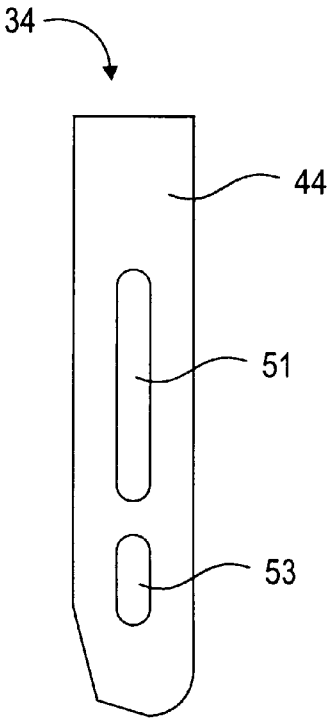
FIG. 9*b* is a end view of the pull latch of FIG. 9*a;*
Figure 9A:
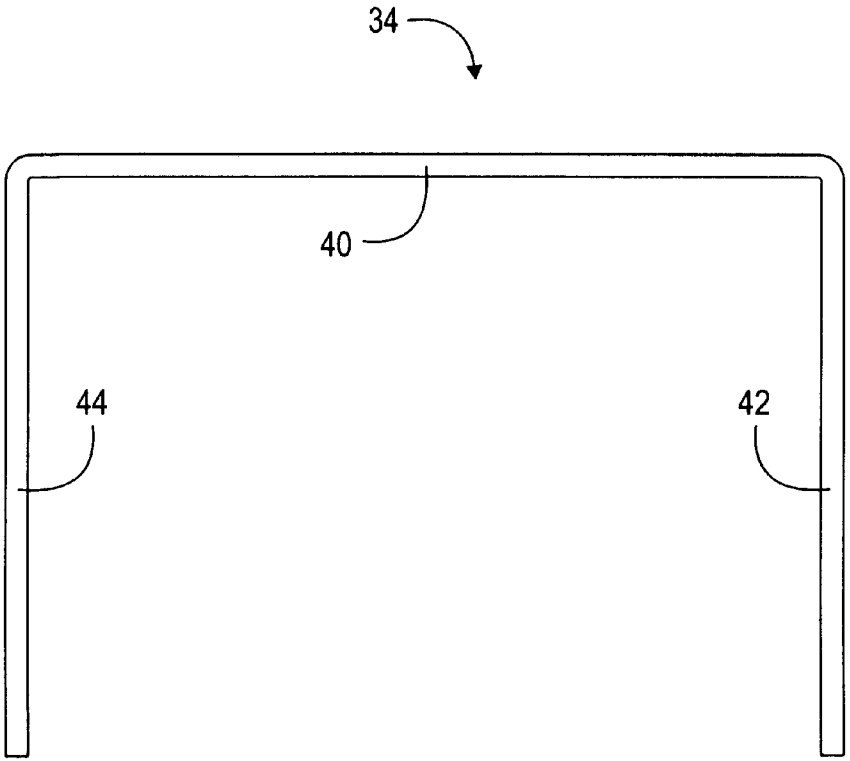
FIG. 9*a* is a top view of a pull latch for use with the latching mechanism of FIG. 4.

A latching mechanism 30 is also secured to the bottom of the table. The latching mechanism 30 can be secured by fasteners such as nails, screws, bolts, etc. The latching mechanism 30 includes latch mounting plates 32 and 33 and a pull latch 34, best illustrated in FIGS. 9*a* and 9*b*. The pull latch 34 being slidably mounted on the latch mounting plates 32 and 33 such that the pull latch 34 is operable between a latched position 36 and an unlatched position 38. (The pull latch 34 is shown in the unlatched position 38 in phantom).

Figure 2:
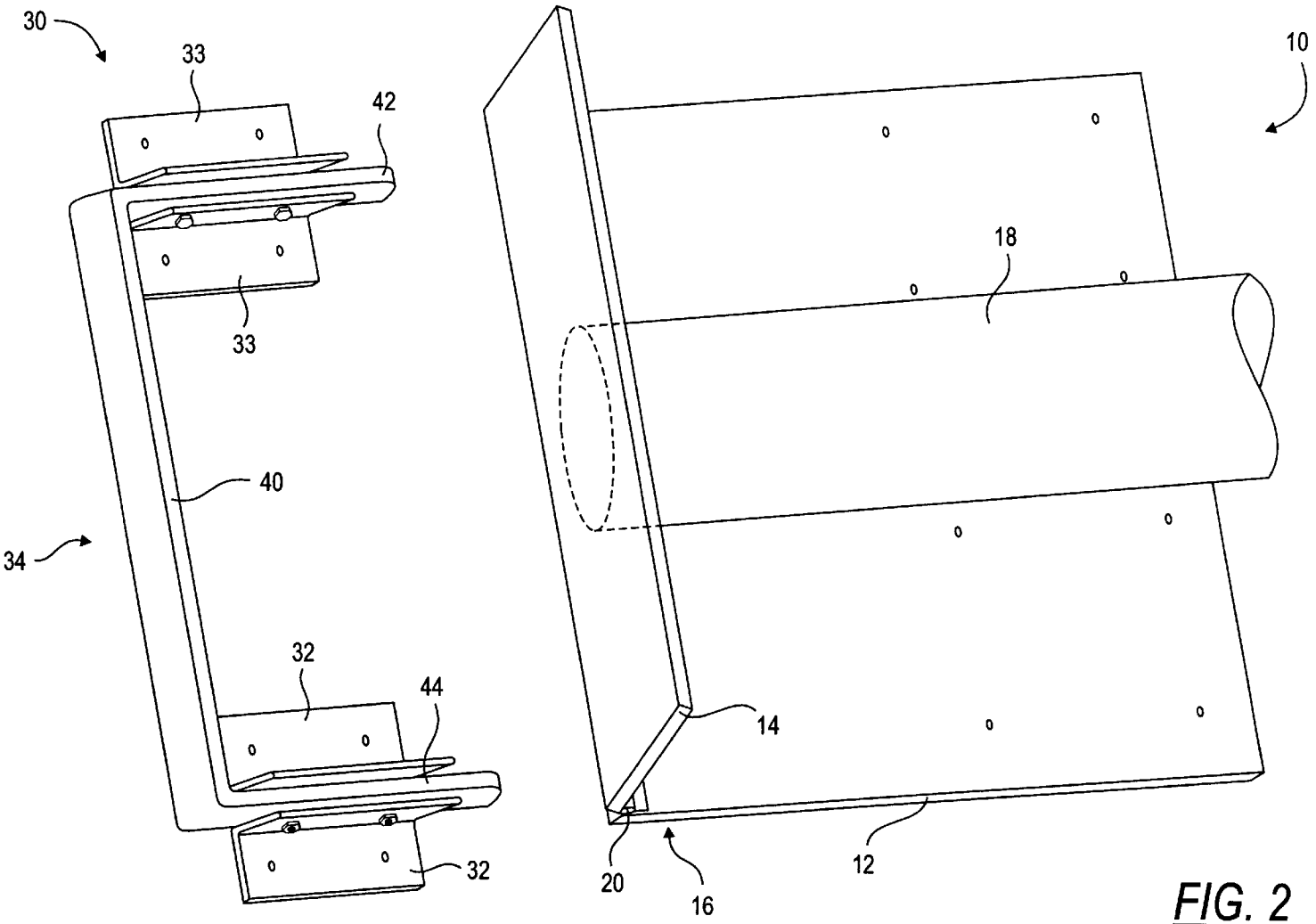
FIG. 2 is a plan view of the folding table base in the closed position.

Referring again to FIG. 1, the pull latch 34 includes a handle portion 40 and two locking members 42 and 44. The locking members 42 and 44 are disposed at respective ends of the handle portion 40 and extend generally orthogonal thereto. The latching mechanism 30 engages the hinge plate 14 when the pull latch 34 is in the latched position and disengages the hinge plate 14 when the pull latch 34 is in the unlatched position. The locking members 42 and 44 of the latching mechanism 30 engage the hinge plate 14 at two displaced locations on the hinge plate. This insures that the hinge plate 14 is securely latched in the horizontal (open) position by the latching mechanism 30. Thus, the leg 18 is securely and stablely extended in a vertical (open) position. Pulling the pull latch 34 to the unlatched position 38 disengages the latching mechanism 30 from the hinge plate 14 allowing the leg 18 to be folded from a vertical position, illustrated in FIG. 1, to a horizontal position, illustrated in FIG. 2. At that point, the pull latch 34 can be released which will return the pull latch 34 to the latched position 36, as illustrated in FIG. 2. This allows for easily folding the table into a compact, easy to store unit.

Figure 4:
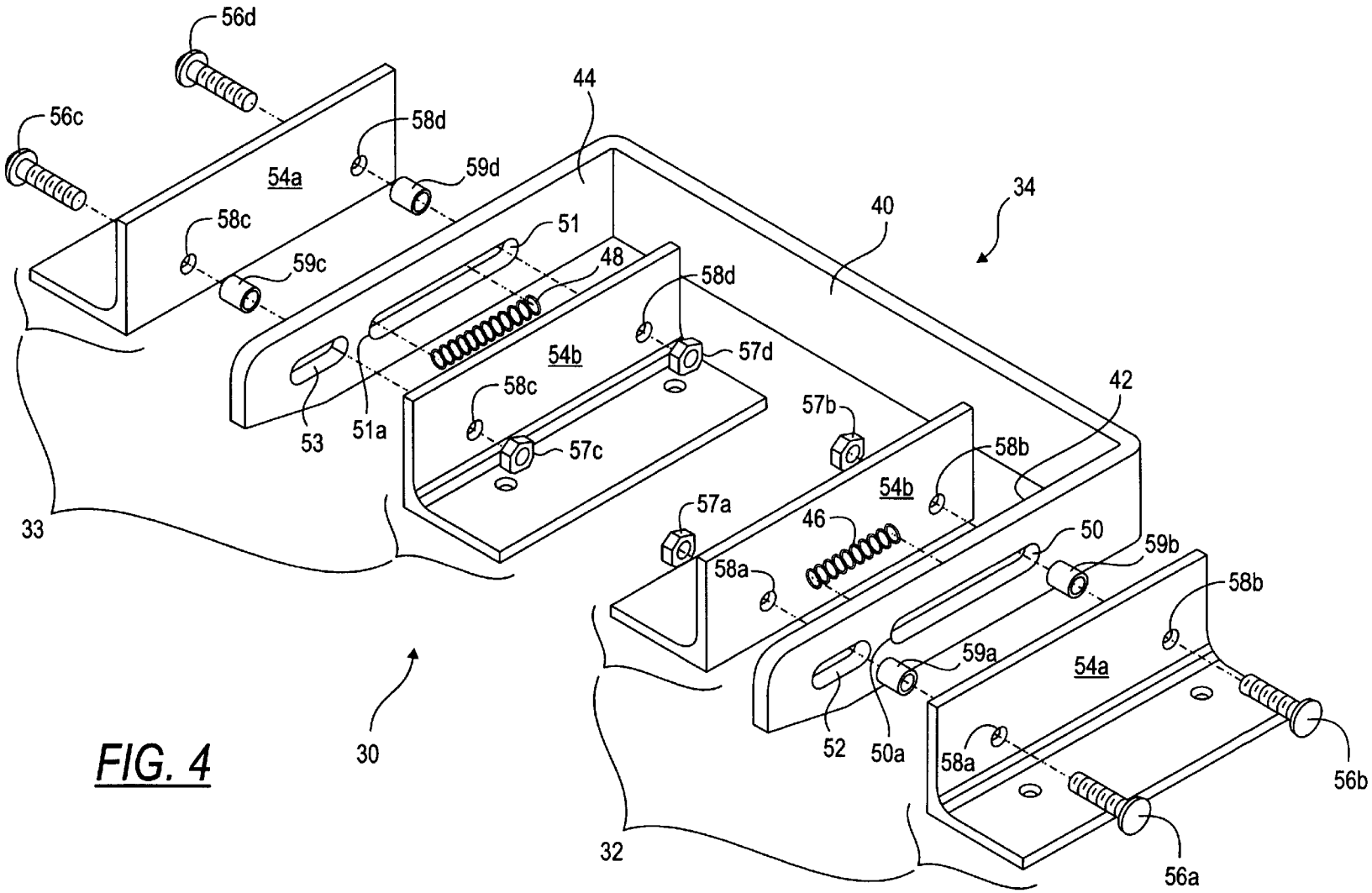
FIG. 4 is an exploded perspective view of a latching mechanism according to the present invention.
Figure 8B:
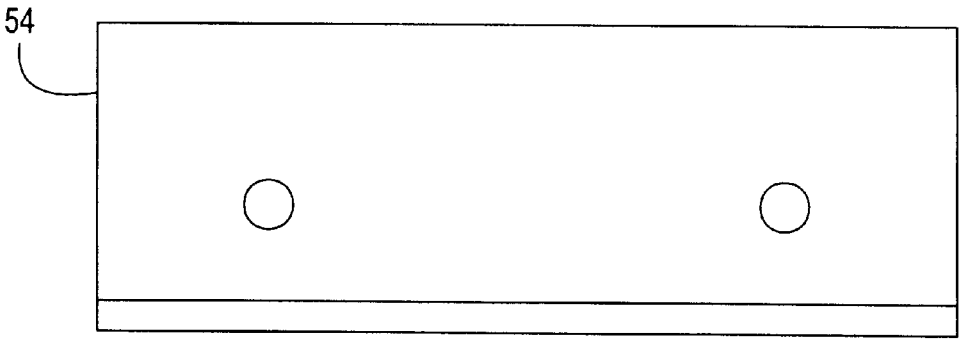
FIG. 8*b* a front view of the hinge plate of FIG. 8*a;*
Figure 8A:
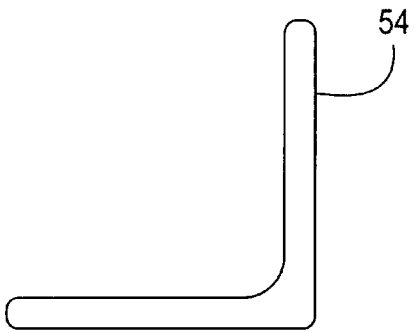
FIG. 8*a* is a side view of a hinge plate for use with the folding table base of FIG. 1.

FIG. 4 illustrates one embodiment where the latch mounting plates 32 and 33 each comprise a pair of angle mounts 54*a* and 54*b*. Each angle mount 54 is identical in construction, as illustrated in FIGS. 8*a* and 8*b*. Each angle mount is secured to the bottom of the table by one or more fasteners (not shown) such as nails, screws, bolts, etc. As illustrated in FIG. 4, the pull latch 34 is slidably mounted between a first pair of angle mounts 54*a*, 54*b* (comprising first latch mounting plate 32) and a second pair of angle mounts 54*a*, 54*b* (comprising second latch mounting plate 33). Fasteners 56*a,b*(e.g., bolts) are inserted through holes 58*a,b* in a first angle mount 54*a* while corresponding fasteners 57*a,b* (e.g., nuts) are secured to the ends of the fasteners 56*a,b* protruding out of the corresponding holes 58*a,b* in a second angle mount 54*b*.

In one embodiment, the pull latch 34 is biased in the latched position by springs 46 and 48. The springs 46 and 48 are located in generally rectangular openings 50 and 51, respectively. The opening 50 and 51 are located in the respective locking members 42 and 44 of the pull latch 34. In this embodiment, a fastener 56*a* is inserted through a hole 58*a* in a first angle mount 54*a* of latch mounting plate 32, and through a sleeve 59*a* disposed in an opening 52. The fastener extends out of the corresponding hole 58*a* in a second angle mount 54*b* and a corresponding fastener 57*a* is secured to the end thereof, as illustrated in FIG. 4. Likewise, a fastener 56*b* is inserted through a hole 58*b* in the first angle mount 54*a* of latch mounting plate 32, and through a sleeve 59*b* disposed in the opening 50. The fastener extends out of the corresponding hole 58*b* in the second angle mount 54*b* and a corresponding fastener 57*b* is secured to the end thereof. Similarly, a fastener 56*c* is inserted through a hole 58*c* in a first angle mount 54*a* of latch mounting plate 33, and through a sleeve 59*c* disposed in an opening 53. The fastener extends out of the corresponding hole 58*c* in a second angle mount 54*b* and a corresponding fastener 57*c* is secured to the end thereof, as illustrated in FIG. 4. Likewise, a fastener 56*d* is inserted through a hole 58*d* in the first angle mount 54*a* of latch mounting plate 33, and through a sleeve 59*d* disposed in the opening 51. The fastener extends out of the corresponding hole 58*d* in the second angle mount 54*b* and a corresponding fastener 57*d* is secured to the end thereof.

The spring 46 is inserted in the generally rectangular opening 50 between the front 50*a* of the opening 50 and the fastener 56*b*. Similarly, the spring 48 is inserted in the generally rectangular opening 51 between the front 51*a* of the opening 51 and the fastener 56*d*. Therefore, when the pull latch 34 is pulled from the latched position 36 to the unlatched position 38, the springs 46 and 48 are compressed between the fronts 50*a*, 51*a* of the openings 50, 51 and the respective bolts 56*b,d*. Releasing the pull latch 34 allows the springs 46, 48 to uncompressed, thus moving the pull latch 34 from the unlatched position 38 to the latched position 36, as illustrated in FIGS. 1, 2 and 4.

Figure 5:
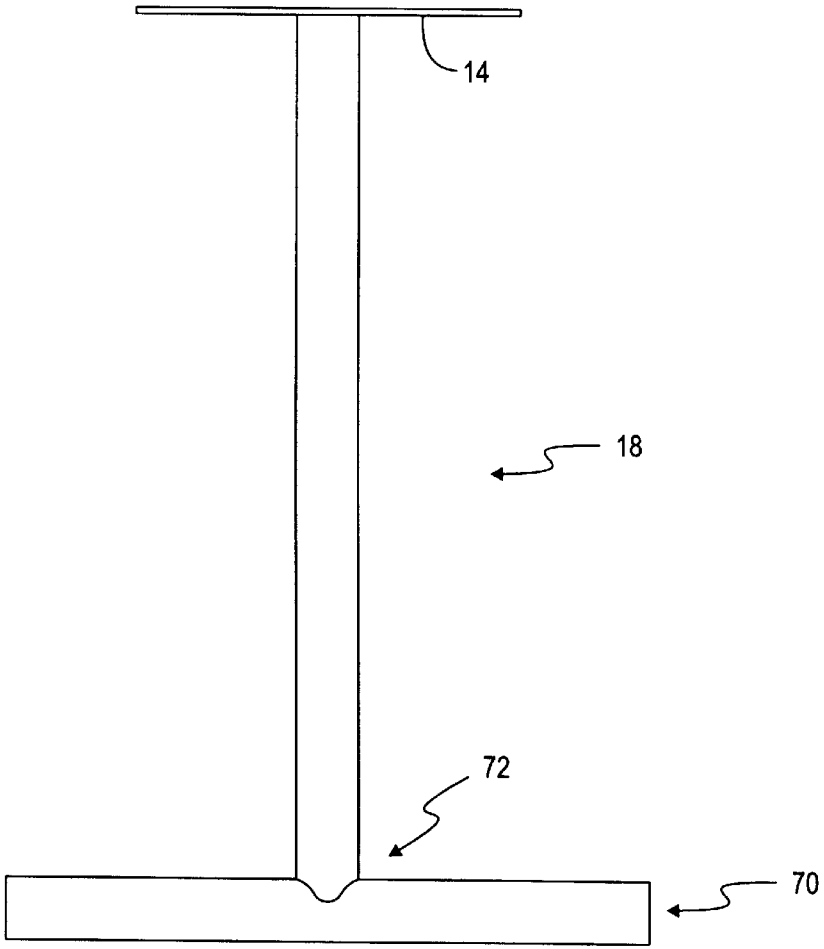
FIG. 5 is a side view of a leg attached to the folding table base of FIG. 1.
Figure 7:
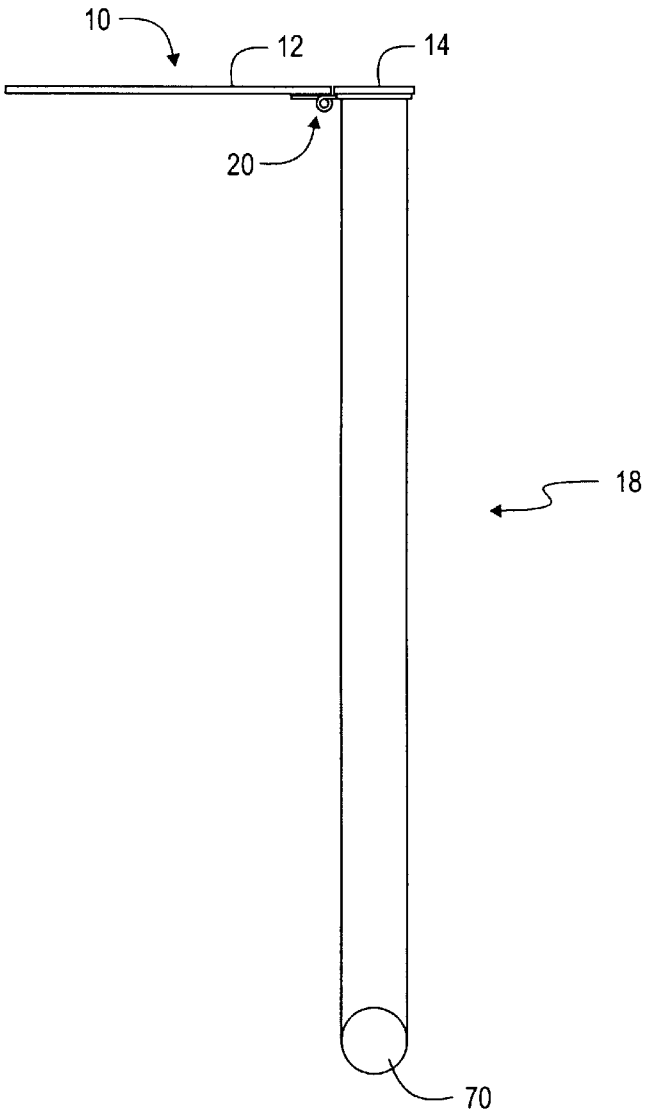
FIG. 7 is a front view of FIG. 5 showing the leg attached to the folding table base.

FIG. 5 illustrates another embodiment where the leg 18 includes a foot 70 secured to a distal end 72 of the leg 18. The foot 70 is generally orthogonal to the leg 18. In one aspect, the foot 70 is tubular, as illustrated in FIG. 5. In another aspect, the foot 70 is a flat plate (not illustrated). FIG. 7 illustrates a front view of the leg 18 and its attachment to the hinge plate 14 of the folding table base 10.

Figure 3:
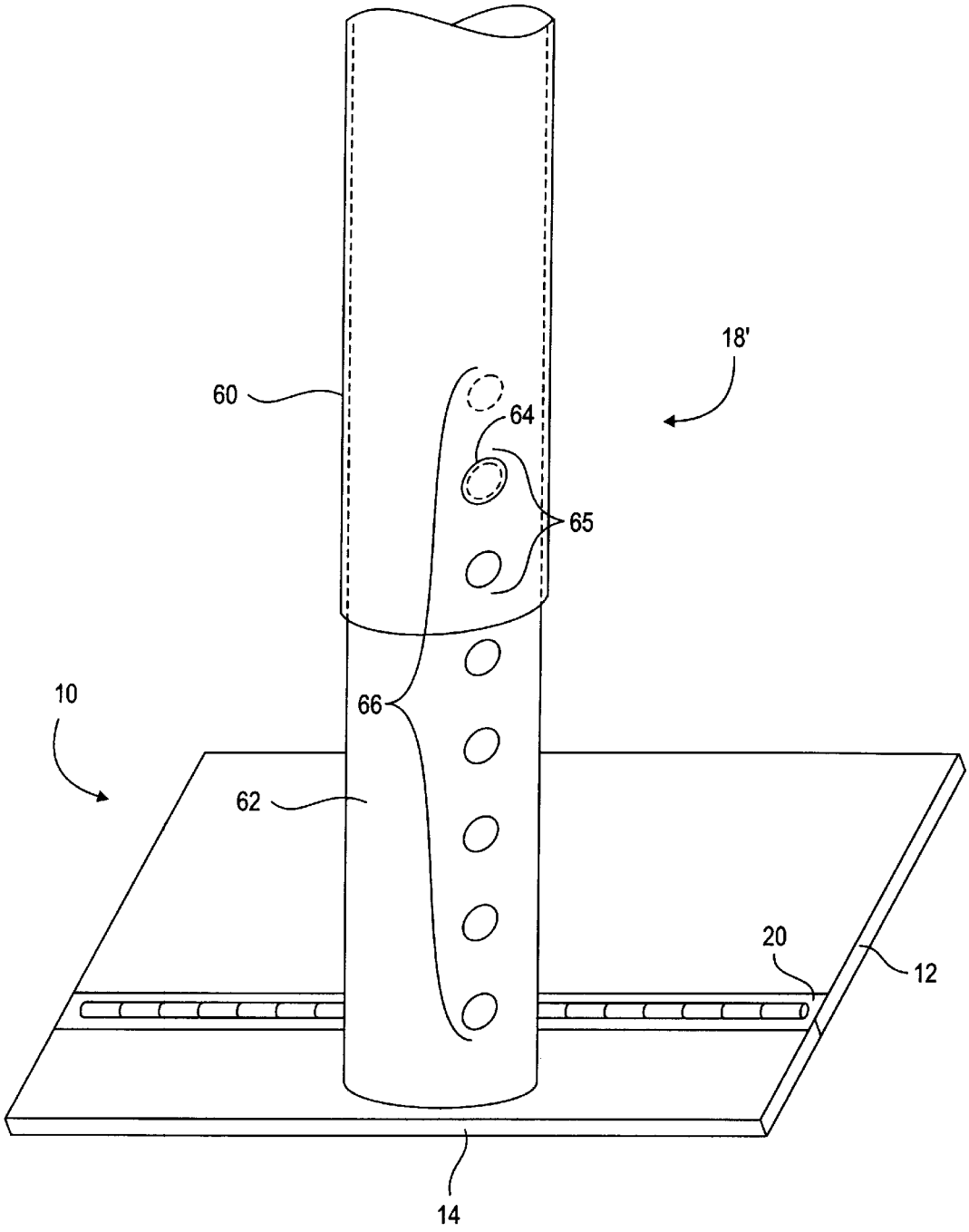
FIG. 3 is a perspective view of an adjustable leg according to the present invention having a first section and a second section.
Figure 6:
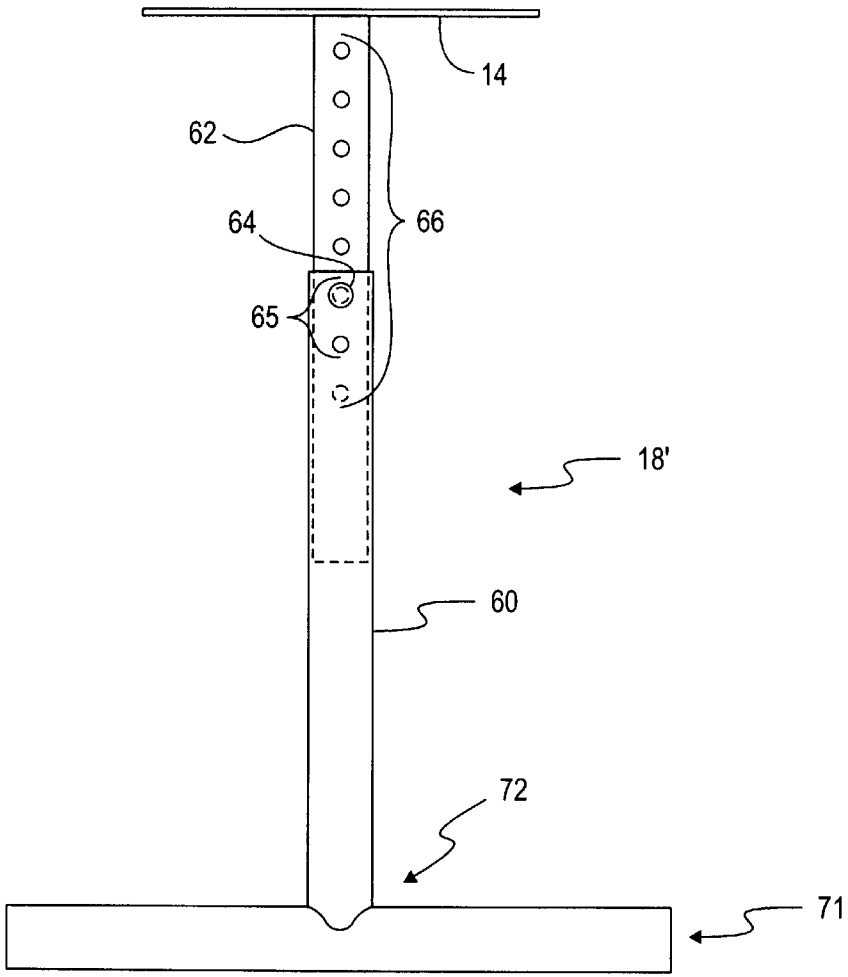
FIG. 6 is a side view of the adjustable leg of FIG. 3 attached to the folding table base of FIG. 1.
Figure 10:
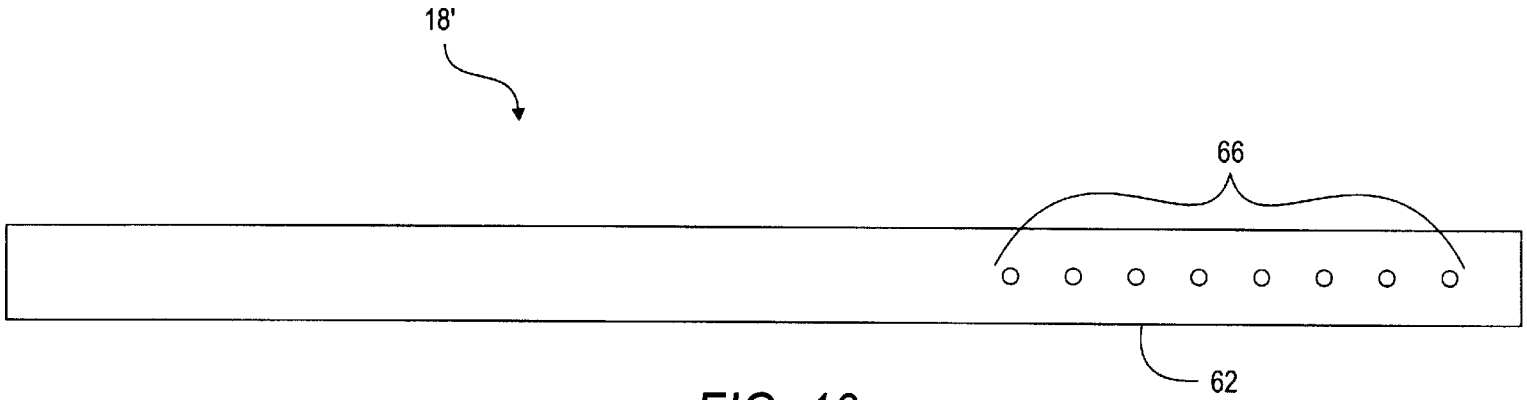
FIG. 10 is a side view of the second section of the adjustable leg of FIG. 3.
Figure 11:
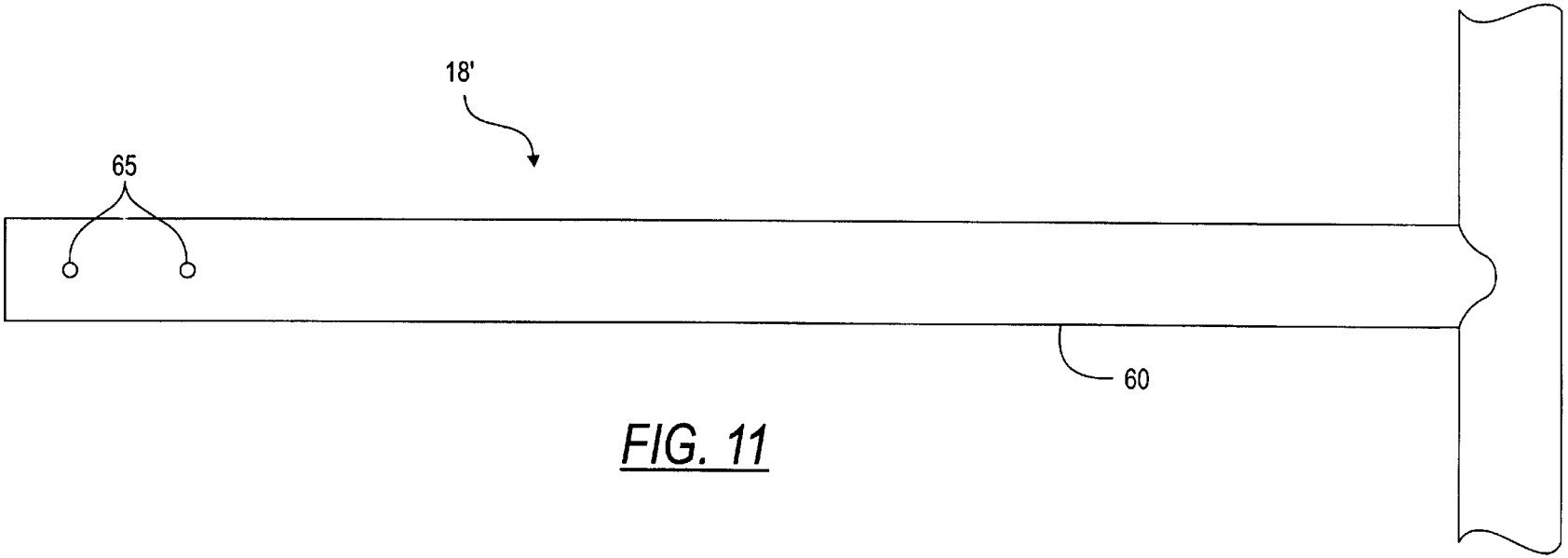
FIG. 11 is a side view of the first section of the adjustable leg of FIG. 3.

FIGS. 3 and 6 illustrate still another embodiment where the leg is telescopicly adjustable. In this embodiment, a leg 18' includes a first tubular section 60 and a second tubular section 62 which is slidably disposed within the first tubular section 60. The second tubular section 62 is secured to the hinge plate 14 and extends generally orthogonal thereto. A foot 71 is secured to the distal end 72 of the first tubular section 60. The first tubular section 60 has a plurality of holes 65 disposed therethrough. The second tubular section 62 has a plurality of holes 66 disposed therethrough. The leg 18' is secured in a particular position by a pin 64 inserted through one pair of aligned holes 65 and 66. FIG. 10 illustrates a side view of the second section 62 while FIG. 11 illustrates the first section 60 of the adjustable leg 18'.

Figure 13A:
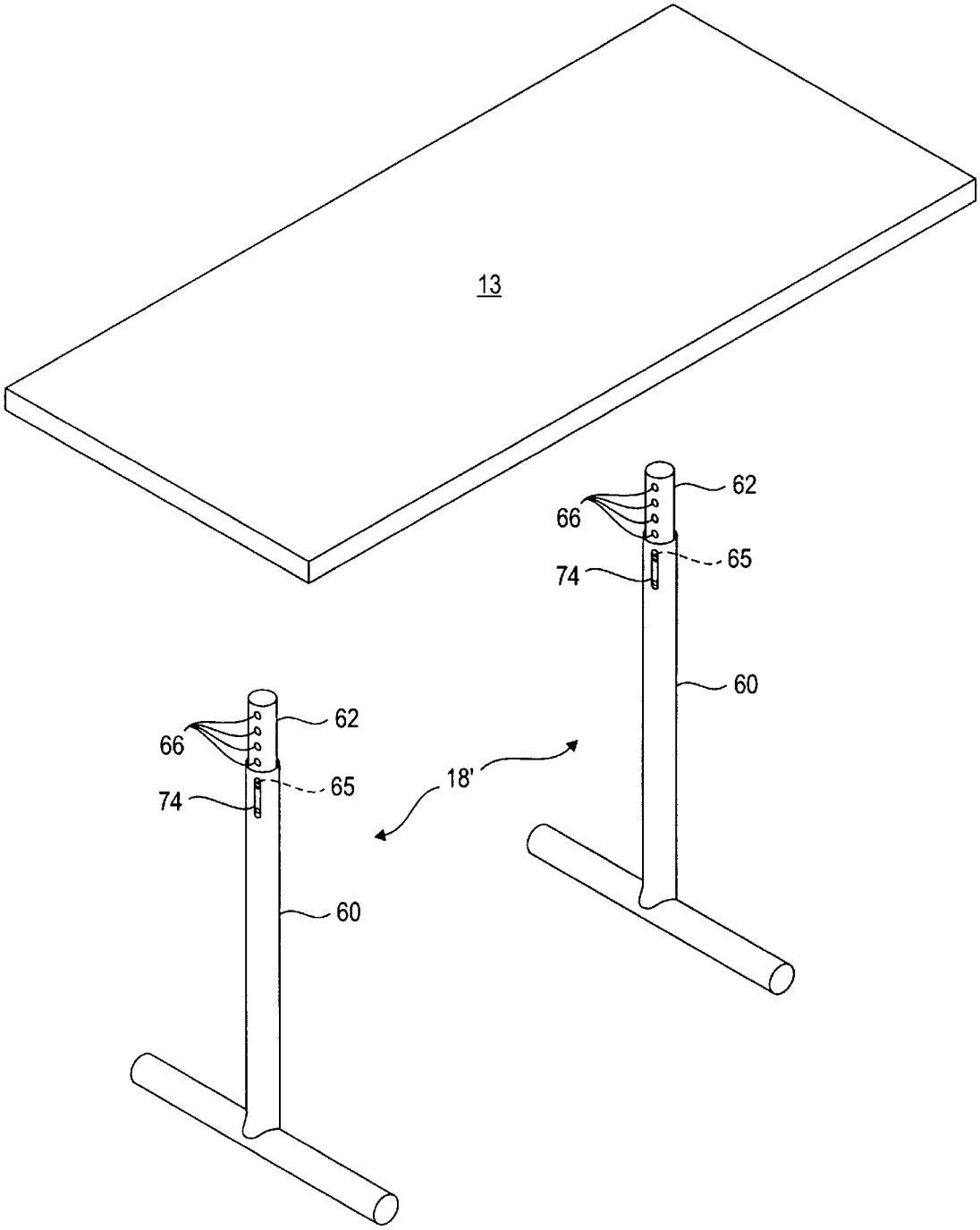
FIG. 13*a* is a perspective view of a pair of adjustable legs and a table for use with the folding table base of FIG. 1.
Figure 13B:
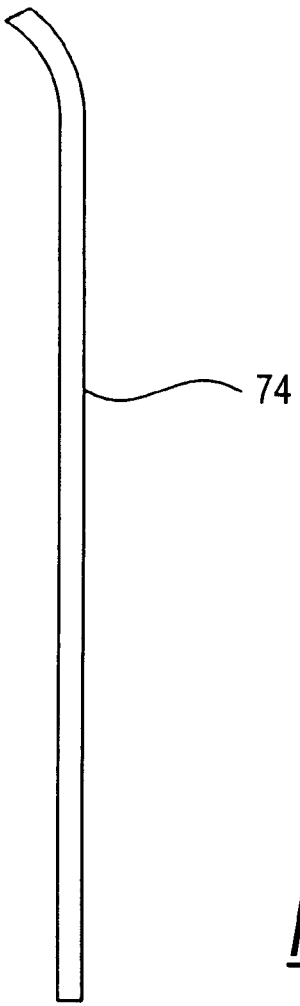
FIG. 13*b* is a side view of a spring tab for use with the adjustable leg of FIGS. 3 and 6.

In another aspect of this embodiment, the leg 18' is secured in place by a spring tab 74, as illustrated in FIG. 13*a*. The spring tab 74 is secured to the first section 60 by welding, fastening, etc. The spring tab 74 is bent at its tip, as illustrated in FIG. 13*b*, such that when one pair of holes 65 and 66 are aligned, the tip of spring tab 74 will protrude into the holes 65 and 66 thus locking the first and second section 60 and 62 in place.

In a further embodiment (not shown), another folding table base 10 is secured to the bottom of the table. In this way, the table has two folding table bases 10 disposed on respective ends of the table for easily folding legs 18 from a closed position to an open position where the legs 18 are stablely locked. After use of the table, the legs 18 can be easily folded to a closed position which facilitates easy storage of the table.

Figure 14:
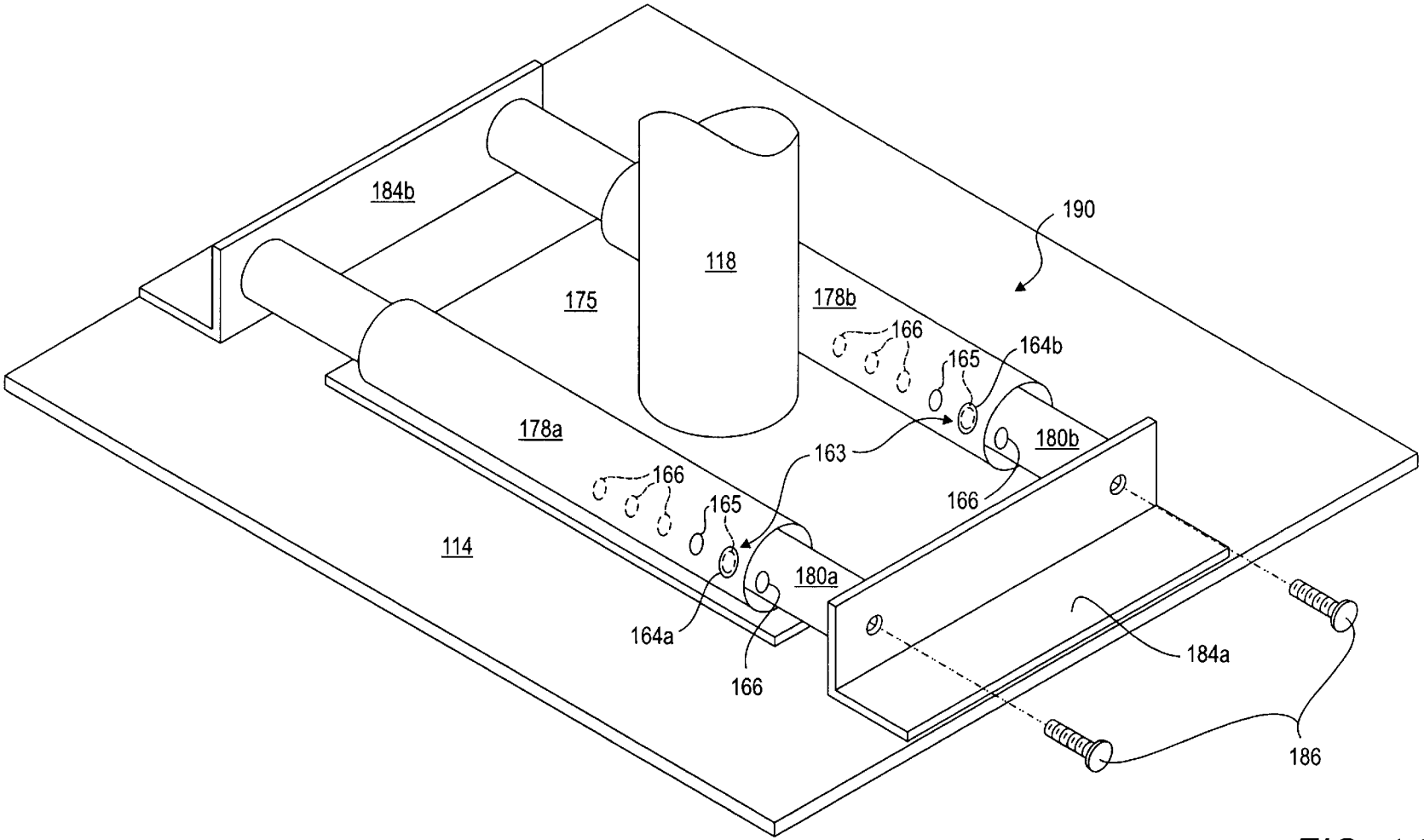
FIG. 14 is a perspective view of a hinge plate for use with the folding table base of FIG. 15.
Figure 15:
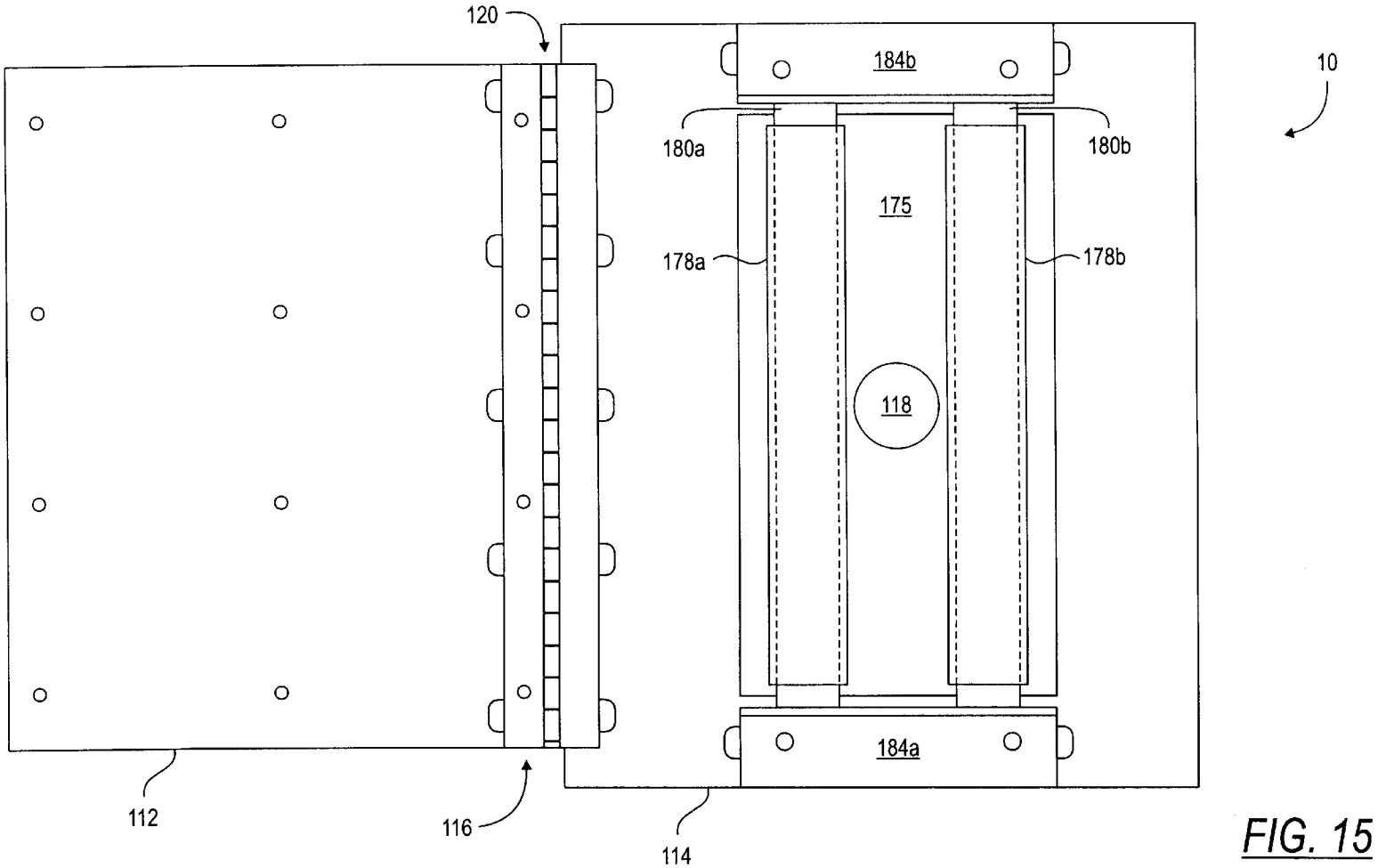
FIG. 15 is a top view of a folding table base including the hinge plate of FIG. 14.

FIGS. 14–15 illustrate another embodiment where the folding table base 10 includes a leg sliding mechanism 190 mechanically secured to the bottom of a table. In one aspect of this embodiment, the leg sliding mechanism 190 is mechanically secured to the bottom of the table by fasteners. In another aspect of this embodiment, the leg sliding mechanism 190 is mechanically secured to the bottom of the table by being secured to a hinge plate 114 that is pivotally connected to a side 116 of a mounting plate 112 by a hinge 120. The hinge 120 is secured to the mounting plate 112 by welding, riveting, fastening, etc. The mounting plate 12 is secured to the bottom of the table by fasteners such as nails, screws, bolts, etc. The hinge plate 114 is adapted to pivot between a first position and a second position, as detailed above with respect to hinge plate 14. The leg sliding mechanism 190 includes a leg 118 extending generally orthogonal thereto. The leg sliding mechanism 190 is adapted to slide between a first position and a second position such that the leg 118 is laterally adjustable with respect to the table. A locking mechanism 163 secures the leg sliding mechanism in a particular position.

Figure 16:
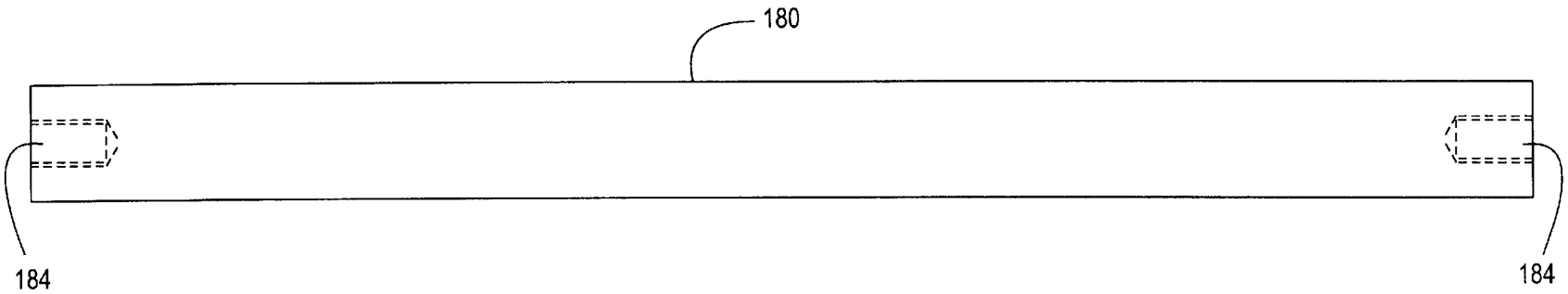
FIG. 16 is a side view of a rod for use with the hinge plate of FIGS. 14 and 15.

In still another aspect of this embodiment, the leg 118 is secured to a leg plate 175 and extends generally orthogonal thereto. The leg 118 is secured to the leg plate 175 by, for example, welding. The leg plate 175 is secured to a pair of hollow pipes 178*a* and 178*b* by, for example, welding. A pair of rods 180*a* and 180*b* are disposed in the hollow pipes 178*a* and 178*b*, respectively. The hollow pipes 178*a,b* slide back and forth on the rods 180*a,b* so the leg 118 can be adjusted laterally (front to back with respect to the table). This allows the legs 118 to be moved laterally away from where a person sits so the legs 118 do not hit the person's legs. The rods 180*a,b* are secured between angle mounts 184*a* and 184*b* by fasteners 186. The rods 180*a,b* are identical in construction, as illustrated in FIG. 16, and include fastener receptacles 184.

In a further aspect of this embodiment, the locking mechanism 163 comprises a pair of pins 164*a,b*. In this aspect, the hollow pipes 178*a,b* each have a plurality of holes 165 disposed therethrough. The rods 180*a,b* each have a plurality of holes 166 disposed therethrough. The hollow pipes 178*a,b* are secured in a particular position by inserting the pins 164*a,b* through one pair of aligned holes 165 and 166. Alternatively, the locking mechanism 163 comprises a pair of spring tabs (not shown) that operate essentially as described above in relation to spring tab 74.

In another aspect of this embodiment, the legs 118 each include a foot like the foot 70 illustrated in FIG. 5. In a further aspect of this embodiment, the legs 118 are each adjustable, like the leg 18' illustrated in FIGS. 3 and 6.

Figure 17B:
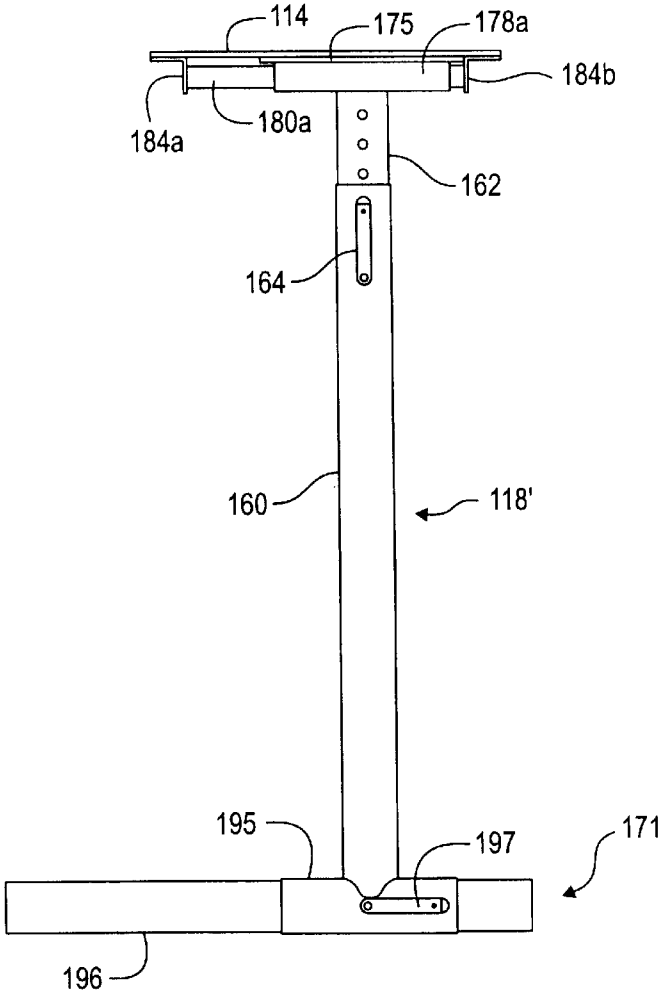
FIG. 17*b* is a side view of the vertically and laterally adjustable leg of FIG. 17*a* in a second position.
Figure 17A:
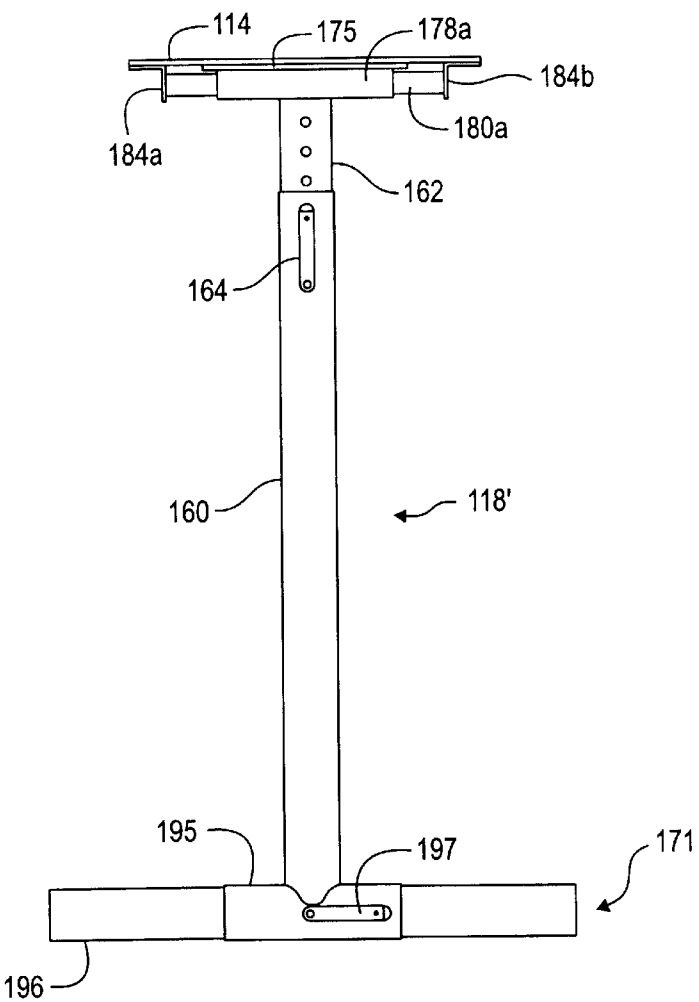
FIG. 17*a* is a side view of a vertically and laterally adjustable leg in a first position.

In still another aspect of this embodiment illustrated in FIGS. 17*a* and 17*b*, the vertically adjustable legs 118' each include a laterally adjustable foot 171. The laterally adjustable foot 171 includes a foot sleeve 195, a foot tube 196 and a foot lock 197. The foot sleeve 195 slides back and forth on the foot tube 196. The foot sleeve 195 is locked in a particular position on the foot tube 196 by the foot lock 197. In one aspect, the foot lock 197 comprises a spring tab that operates essentially as described above in relation to spring tab 74. In another aspect, the foot lock 197 comprises a pin (not shown) that operates essentially as described above in relation to pin 64. Therefore, when the legs 118' are moved laterally away from the user, the stability of the table is maintained by moving each leg tube 196 laterally toward the user, and vice versa.

With the exception of the lateral movement of the leg 118, the operation of the hinge plate 114 is the same as the hinge plate 14 described above. Therefore, a detailed description of how the latching mechanism interacts with the hinge plate 114, etc. has been omitted.

Other aspects, features, advantages and modifications of the present invention will become apparent to those skilled in the art upon studying this invention. All such aspects, features, advantages and modifications of the present invention are intended to be within the scope of the present invention as defined by the appended claims.

What is claimed is:

1. A folding table base for connection to the bottom of a table, said folding table base comprising:

a mounting plate adapted to be secured to the bottom of the table, said mounting plate having a side;

a hinge plate hingedly connected to said side of said mounting plate, said hinge plate being adapted to pivot between a first position and a second position;

a leg secured to said hinge plate and extending generally orthogonal thereto; and a latching mechanism adapted to be secured to the bottom of said table, said latching mechanism including a latch mounting plate and a pull latch, said pull latch being slidably mounted on said latch mounting plate such that said pull latch is operable between a latched position and an unlatched position, said latching mechanism engaging said hinge plate when said pull latch is in said latched position, said latching mechanism disengaging said hinge plate when said pull latch is in said unlatched position.

2. The folding table base of claim 1, wherein said pull latch is biased in said latched position by a spring.

3. The folding table base of claim 1, wherein said leg is telescopicly adjustable.

4. The folding table base of claim 3, wherein said adjustable leg is secured in a particular position by a pin.

5. The folding table base of claim 3, wherein said adjustable leg is secured in a particular position by a spring tab.

6. The folding table base of claim 1, wherein said leg includes a foot secured to a distal end of said leg, said foot being generally orthogonal to said leg.

7. The folding table base of claim 1, wherein said hinge plate is pivotally connected to said side of said mounting plate by a hinge.

8. The folding table base of claim 1, wherein said latch mounting plate includes a first pair of angle mounts.

9. The folding table base of claim 8, wherein said latch mounting plate includes a second pair of angle mounts.

10. The folding table base of claim 9, wherein said pull latch includes a handle portion and two locking members, said locking members being disposed at respective ends of said handle portion and extending generally orthogonal thereto.

11. The folding table base of claim 10, wherein said pull latch is slidably mounted between said first pair of angle mounts and said second pair of angle mounts, respectively.

12. The folding table base of claim 10, wherein said locking members are slidably mounted between said first pair of angle mounts and said second pair of angle mounts, respectively.

13. The folding table base of claim 10, wherein said pull latch is biased in said latched position by a pair of springs, said springs being located in respective generally rectangular openings located in said respective locking members.

14. The folding table base of claim 1, wherein said first hinge plate includes a leg sliding mechanism, said leg sliding mechanism being adapted to slide between a first position and a second position such that said first leg is laterally adjustable with respect to the table.

15. A folding table base for connection to the bottom of a table, said folding table base comprising:

a mounting plate adapted to be secured to the bottom of the table, said mounting plate having a side;

a hinge plate hingedly connected to said side of said mounting plate, said hinge plate being adapted to pivot between a first position and a second position;

a leg secured to said hinge plate and extending generally orthogonal thereto; and a latching mechanism adapted to be secured to the bottom of said table, said latching mechanism including a pair of latch mounting plates and a pull latch, said pull latch including a handle portion and two locking members, said locking members being disposed at respective ends of said handle portion and extending generally orthogonal thereto, said pull latch being slidably mounted on said latch mounting plates such that said locking members engage said hinge plate at two displaced locations when said pull latch is in a latched position and disengage said hinge plate when said pull latch is in an unlatched position.

16. The folding table base of claim 15, wherein said pull latch is biased in said latched position by a spring.

17. The folding table base of claim 15, wherein said leg is telescopicly adjustable.

18. The folding table base of claim 17, wherein said adjustable leg is secured in a particular position by a pin.

19. The folding table base of claim 17, wherein said adjustable leg is secured in a particular position by a spring tab.

20. The folding table base of claim 15, wherein said leg includes a foot secured to a distal end of said leg, said foot being generally orthogonal to said leg.

21. The folding table base of claim 15, wherein said hinge plate is pivotally connected to said side of said mounting plate by a hinge.

22. The folding table base of claim 15, wherein said pair of latch mounting plates includes a first pair of angle mounts and a second pair of angle mounts, respectively.

23. The folding table base of claim 22, wherein said pull latch is slidably mounted between said first pair of angle mounts and said second pair of angle mounts, respectively.

24. The folding table base of claim 22, wherein said locking members are slidably mounted between said first pair of angle mounts and said second pair of angle mounts, respectively.

25. The folding table base of claim 15, wherein said pull latch is biased in said latched position by a pair of springs, said springs being located in respective generally rectangular openings located in said respective locking members.

26. A method for forming a folding table base for connection to the bottom of a table, said method comprising the steps of:

securing a first mounting plate to the bottom of the table, said mounting plate having a first side;

securing a second mounting plate to the bottom of said table, said mounting plate having a second side;

connected a first hinge plate to said first side of said mounting plate such that the hinge plate pivots between an open position and a closed position;

connected a second hinge plate to said second side of said mounting plate such that the hinge plate pivots between said open position and said closed position;

securing a first leg to said first hinge plate such that it extends generally orthogonal thereto;

securing a second leg to said second hinge plate such that it extends generally orthogonal thereto;

securing a first latching mechanism to the bottom of said table, said first latching mechanism including a first latch mounting plate and a first pull latch;

securing a second latching mechanism to the bottom of said table, said latching mechanism including a second latch mounting plate and a second pull latch; and slidably mounting said first and second pull latches on said first and second latch mounting plates, respectively, such that said first and second pull latches are operable between a latched position and an unlatched position.

27. The method of claim 26, further including the steps of:

engaging said first latching mechanism with said first hinge plate when said first pull latch is in said latched position; and disengaging said first latching mechanism from said first hinge plate when said first pull latch is in said unlatched position.

28. The method of claim 26, further including the steps of:

engaging said second latching mechanism with said second hinge plate when said second pull latch is in said latched position; and disengaging said second latching mechanism from said second hinge plate when said second pull latch is in said unlatched position.

29. The method of claim 26, further including the step of biasing said first and second pull latches in said latched position by a first spring and a second spring, respectively.

30. The method of claim 26, further including the step of telescopicly adjusting said first leg.

31. The method of claim 26, wherein said first leg is an adjustable leg, and further including the step of securing said first adjustable leg in a particular position by a pin.

32. The method of claim 26, wherein said first leg is an adjustable leg, and further including the step of securing said first adjustable leg in a particular position by a spring tab.

33. The method of claim 26, further including the step of securing a foot to a distal end of said first leg such that said foot is generally orthogonal to said first leg.

34. The method of claim 26, further including the steps of:

mechanically securing a leg sliding mechanism to said first hinge plate, said leg sliding mechanism being adapted to slide between a first position and a second position such that said first leg is laterally adjustable with respect to the table.

35. A folding table base for connection to the bottom of a table, said folding table base comprising:

a first mounting plate adapted to be secured to the bottom of the table, said first mounting plate having a first side;

a second mounting plate adapted to be secured to the bottom of said table, said second mounting plate having a second side;

a first hinge plate hingedly connected to said first side of said first mounting plate, said first hinge plate being adapted to pivot between an open position and a closed position;

a second hinge plate hingedly connected to said second side of said second mounting plate, said second hinge plate being adapted to pivot between said open position and said closed position;

a first leg secured to said first hinge plate and extending generally orthogonal thereto;

a second leg secured to said second hinge plate and extending generally orthogonal thereto;

a first latching mechanism adapted to be secured to the bottom of said table, said first latching mechanism including a first pull latch that engages said first hinge plate when said first pull latch is in said latched position and disengages said first hinge plate when said first pull latch is in said unlatched position; and a second latching mechanism adapted to be secured to the bottom of said table, said second latching mechanism including a second pull latch that engages said second hinge plate when said second pull latch is in said latched position and disengaging said second hinge plate when said second pull latch is in said unlatched position.

36. The folding table base of claim 35, wherein said first and second mounting plates are formed from a unitary piece of metal.

37. The folding table base of claim 35, wherein said first pull latch is biased in said latched position by a spring.

38. The folding table base of claim 35, wherein said first leg is telescopicly adjustable.

39. The folding table base of claim 38, wherein said first adjustable leg is secured in a particular position by a pin.

40. The folding table base of claim 38, wherein said first adjustable leg is secured in a particular position by a spring tab.

41. The folding table base of claim 35, wherein said first leg includes a foot secured to a distal end of said first leg, said foot being generally orthogonal to said first leg.

42. The folding table base of claim 35, wherein said first hinge plate is pivotally connected to said first side of said first mounting plate by a hinge.

43. The folding table base of claim 35, further including a first latch mounting plate and a second latch mounting plate, said first pull latch being slidably mounted on said first latch mounting plate and said second pull latch being slidably mounted on said second latch mounting plate.

44. The folding table base of claim 43, wherein said first latch mounting plate includes a first pair and a second pair of angle mounts.

45. The folding table base of claim 44, wherein said first pull latch is slidably mounted between said first pair of angle mounts and said second pair of angle mounts, respectively.

46. The folding table base of claim 35, wherein said first pull latch includes a handle portion and two locking members, said locking members being disposed at respective ends of said handle portion and extending generally orthogonal thereto.

47. The folding table base of claim 46, wherein said first pull latch is biased in said latched position by a pair of springs, said springs being located in respective generally rectangular openings located in said respective locking members.

48. The folding table base of claim 46, wherein said first hinge plate includes a leg sliding mechanism, said leg sliding mechanism being adapted to slide between a first position and a second position such that said first leg is laterally adjustable with respect to the table.

* * * * *